United States Patent [19]

Johnson

[11] 4,181,092

[45] Jan. 1, 1980

[54] MACHINE FOR TREATING PIPE INTERIORS

[76] Inventor: Charles Johnson, 5575 Grant St., North Burnaby, British Columbia, Canada, V5B 2K2

[21] Appl. No.: 876,683

[22] Filed: Feb. 10, 1978

[51] Int. Cl.[2] ..... B05C 7/02; B24C 3/32

[52] U.S. Cl. ..... 118/72; 51/411; 118/306

[58] Field of Search ..... 118/DIG. 10, 105, 306, 118/308, 72; 51/411, 436; 15/104.05

[56] References Cited

U.S. PATENT DOCUMENTS

| | | | |
|---|---|---|---|
| 1,942,876 | 1/1934 | Perkins | 118/306 |
| 2,140,298 | 12/1938 | Miller | 118/306 X |
| 2,168,917 | 8/1939 | Perkins | 118/105 X |
| 2,185,570 | 1/1940 | Ridley | 118/306 |
| 2,468,984 | 5/1949 | Krieg et al. | 51/411 |

*Primary Examiner*—John P. McIntosh
*Attorney, Agent, or Firm*—Harris, Kern, Wallen & Tinsley

[57] ABSTRACT

A machine for treating a pipe interior includes a carriage movable longitudinally through the pipe. A support structure is mounted on the carriage and journalled at the top of this structure is a tubular shaft which is mounted to rotate about its own longitudinal axis with that axis being substantially aligned with the corresponding axis of the pipe. Secured to one end of the tubular shaft is a pair of material-conveying tubular arms which are radially disposed with respect to the shaft. A supply hose leading to a source of pressure-driven fluid material is coupled to the opposite end of the tubular shaft. At the junction of the tubular shaft and arms, there is a deflector member which deflects a particular fluid material flowing through the shaft into the amrs so as to be discharged against the pipe interior as the carriage moves through the pipe. A different fluid material can be applied to the pipe interior during a subsequent trip of the machine through the pipe when an inner tube is installed within the tubular shaft. This tube is connected at one end to other radially disposed arms and at the opposite end to another supply hose substituted for the first supply hose. Thus, the same machine can be assembled to perform two separate pipe treating operations such as sandblasting and painting.

4 Claims, 6 Drawing Figures

87
86
80
4
116
20
10
100
4
54
80
18
51
53
86
87
50
57
31
14
45
38
46
44
16
42
41
42
36
39
40
31
30
35
31

87
86
80
22
12
20
54
3
80
10
53
18
86
87
51
51
36
39
50
36
39
31
31
35
3
57
14
35

MACHINE FOR TREATING PIPE INTERIORS

This invention relates to machines for performing maintenance work on large-diameter conduits and more particularly to a machine for sandblasting and painting the interior of a penstock or the like.

A hydroelectric power station has penstocks which present special problems when it becomes necessary to clean and paint the pipe interiors. At a known site regarded as being typical, the pipes are arranged as a group of four to slope downwardly at 6° from their upper or intake ends to their lower or power house ends. Each penstock is approximately 850 feet in length and, near the lower end, the pipe has a 150 foot section which is inclined downwardly at an angle of 70°. A 50 foot section extends from the 150 foot section to enter the power house turbines and this creates a double bend in the pipe. Furthermore, the lower 50 foot sections are spaced 50 feet apart as compared with the spacing between the 850 foot main sections of twelve feet. The upper ends of the pipe have an inside diameter of 22 feet while the lower ends have a corresponding diameter of only 18 feet.

Such penstocks are extremely difficult to clean and paint using conventional methods. The job calls for huge scaffolds and heavy equipment which normally must be entered into the upper ends of the pipes. This makes it necessary to continuously adjust the scaffolds to contend with the varying diameter of the pipes, the double bends, and the extra wide spacing between the lower or 50 foot sections of the penstocks. Obviously, the task is not only difficult but time consuming and costly in terms of both equipment and labor.

The present invention offers effective solutions to the above as well as other pipe treating problems by providing a machine which is designed to do the cleaning by sandblasting and later the painting during successive runs through the pipe. A windmill assembly of the machine carries both the sand and paint nozzles and a mechanism is provided whereby the position of the assembly can be adjusted so as to remain centered within the penstock at all times. This adjustment allows the machine to cope with the reverse bends and varying diameters without slowing either operation to any apreciable extent. The machine rolls by gravity from the high to low ends of the pipes and pulls along the few cables and supply hoses required as it does so, the machine being self propelled to travel in the opposite direction. Thus, the cleaning and painting operations can be performed relatively quickly and easily without the need for scaffolds and by fewer men than have hitherto been required to do the same job manually.

More specifically, apparatus according to the present invention may be defined as a machine for treating pipe interiors which comprises a carriage movable longitudinally through said pipe, a support structure mounted on the carriage, a tubular shaft having opposite ends, mounting means securing the tubular shaft to the support structure for rotation about the longitudinal axis of said shaft and with said axis substantially aligned with the corresponding axis of the pipe, a plurality of material-conveying tubular arms radially disposed with respect to the tubular shaft and having outer ends near the interior surface and inner ends, securing means attaching the inner ends of the tubular arms to one end of the tubular shaft, a supply hose connectable at one end thereof to a source of pressure-driven fluid material, coupling means non-rotatably securing an opposite end of the supply hose to the mounting means in communication with the other end of the tubular shaft, a deflector member mounted in the securing means and adapted to deflect the fluid material flowing through the tubular shaft into the tubular arms, and drive means on the support structure for rotating the tubular shaft and the tubular arms whereby the fluid material discharging from the outer ends is applied to the interior surface as the carriage moves through the pipe.

In drawings which illustrate a preferred embodiment of the invention:

Figure 1:
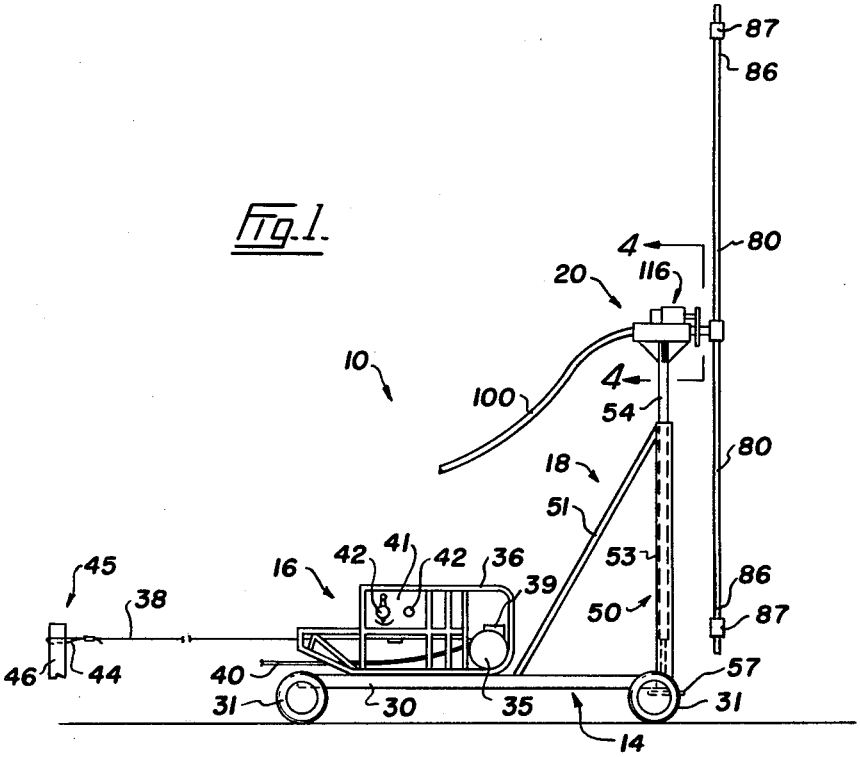
FIG. 1 is a side elevation of the machine for treating pipe interiors.
Figure 2:
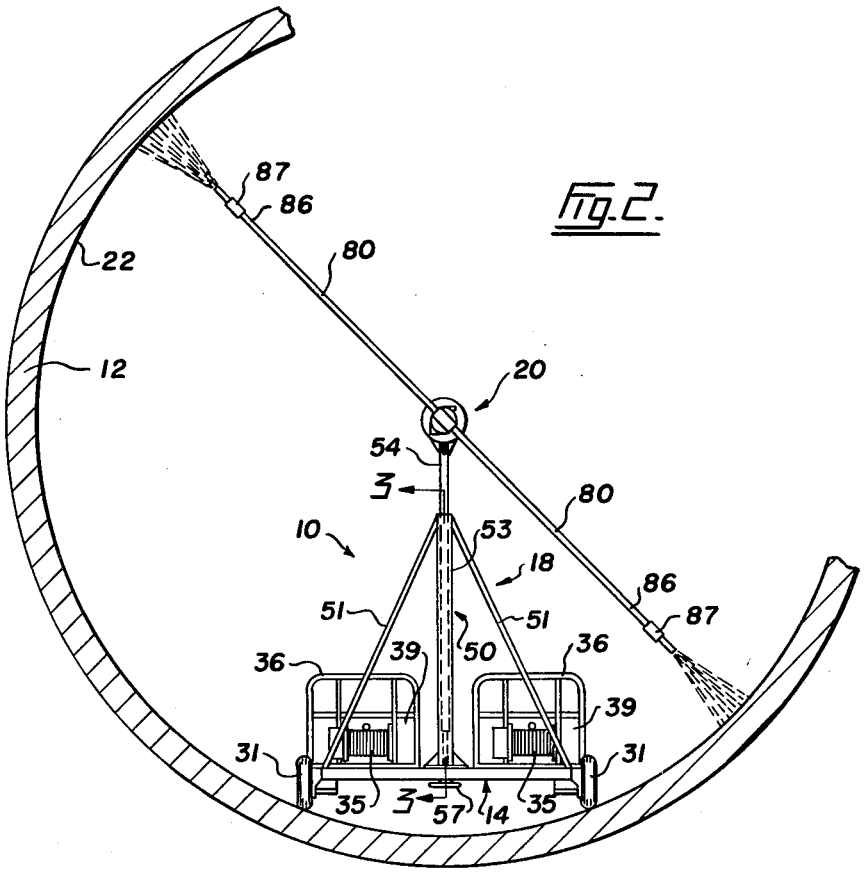
FIG. 2 is a rear elevation of the machine.
Figure 3:
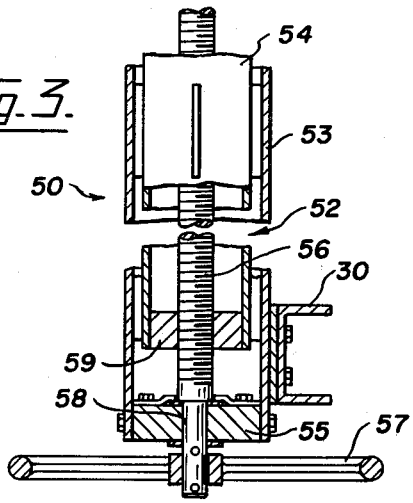
Figure 4:
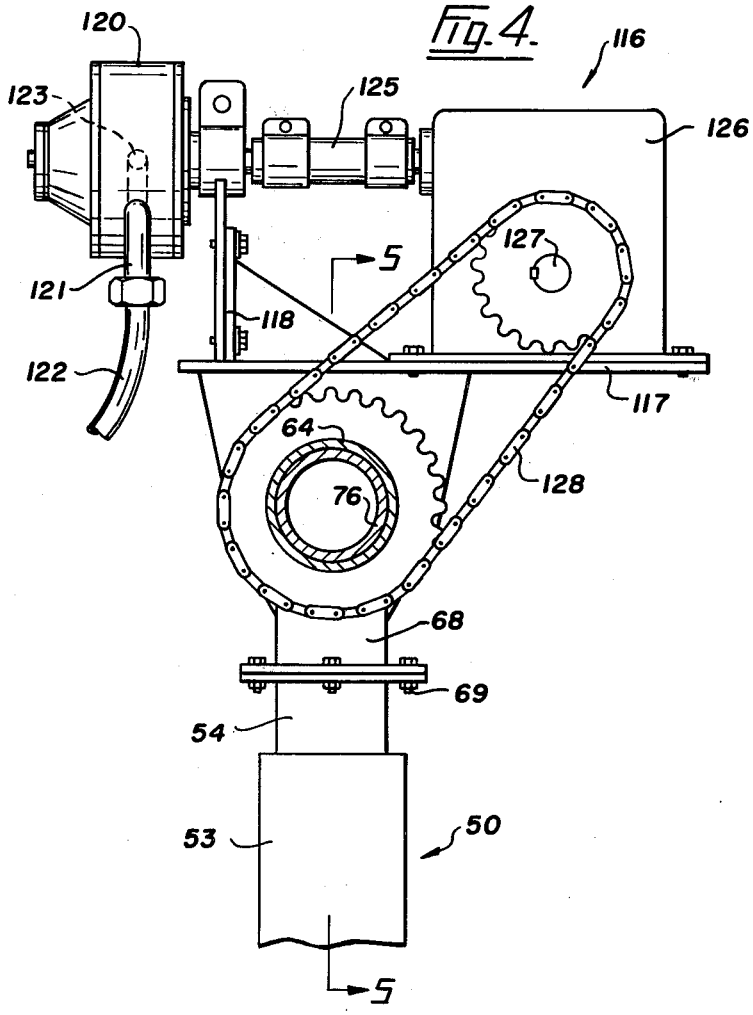
Figure 5:
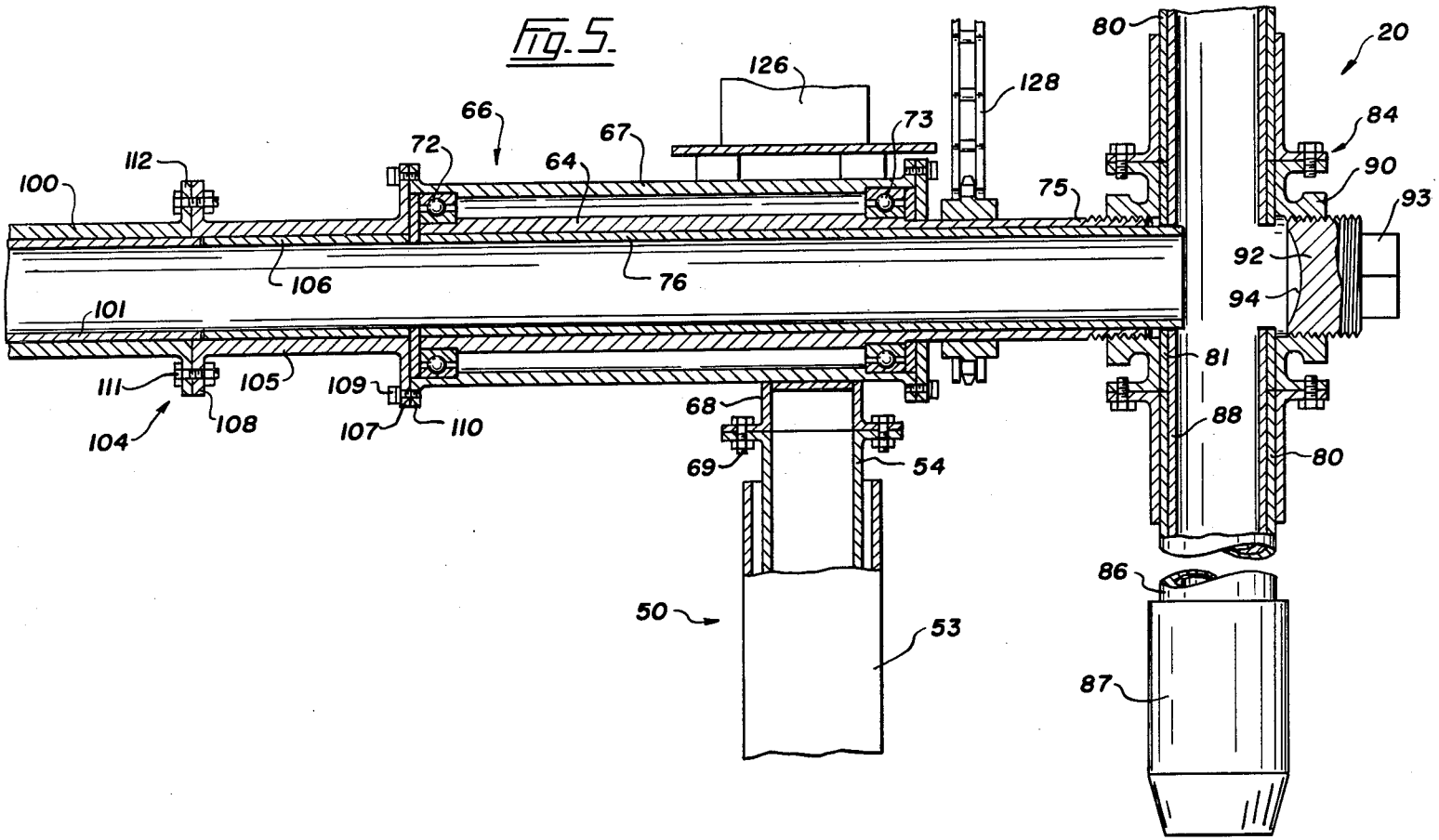
Figure 6:
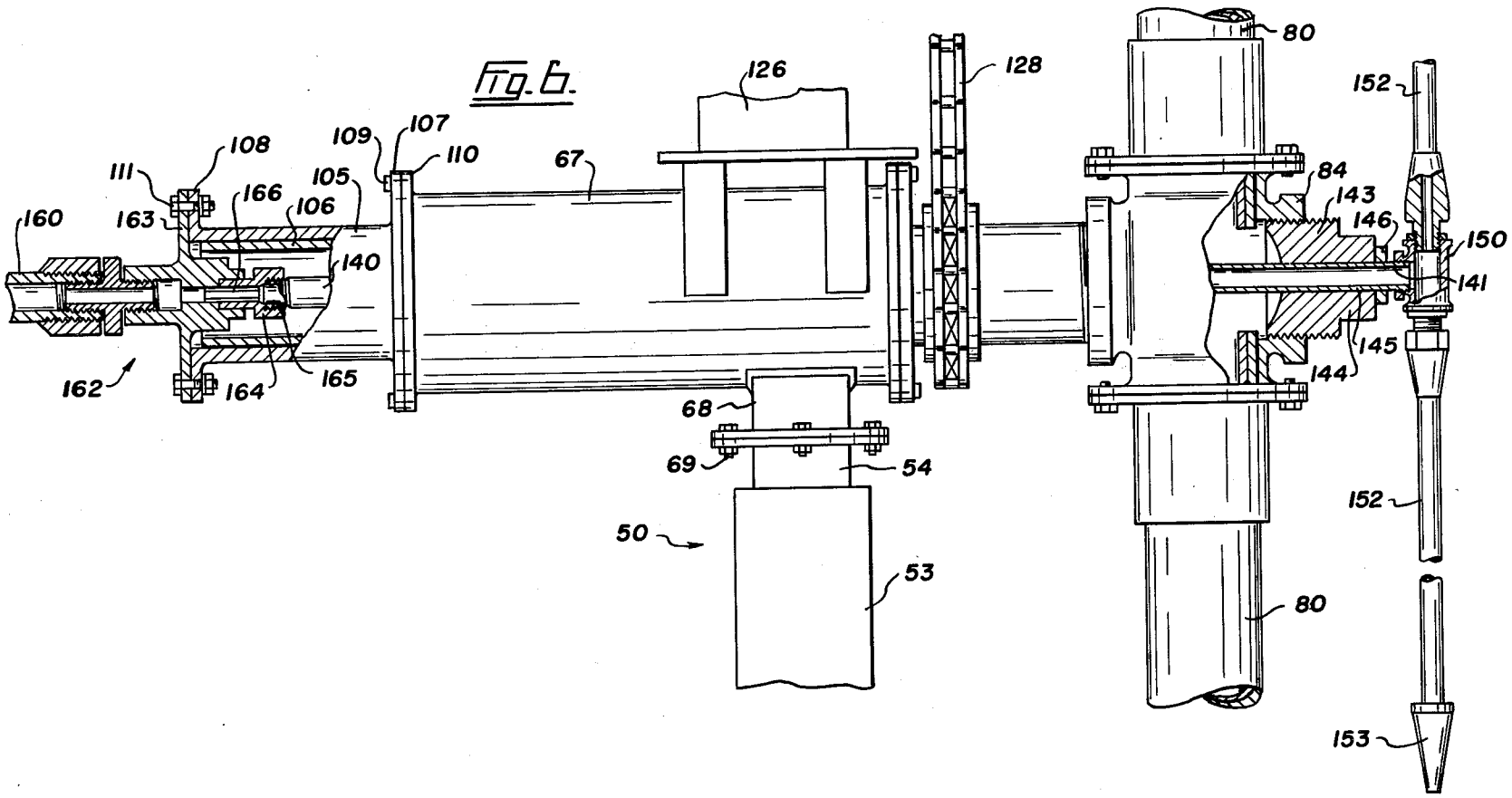

FIG. 3 is an enlarged vertical section taken on line 3—3 of FIG. 2, with parts broken away, and shown in details of manually-operated means for extending and retracting a mast of the machine, FIG. 4 is a similar sectional view taken on the line 4—4 of FIG. 1 and showing drive means for a windmill assembly of the machine, FIG. 5 is a longitudinal section taken on the lines 5—5 of FIG. 4 and showing details of the windmill assembly as used on a sandblasting operation, and FIG. 6 is a side elevation, part in section, showing the windmill assembly as used in a painting operation.

Referring to the drawings, the numeral 10 indicates generally a machine constructed in accordance with the present invention. The machine was designed primarily for use in cleaning and painting the interior of pipes such as the one indicated at 12 in FIG. 2 only. This particular penstock or pipe has an inside diameter of which varies from 18 to 22 feet so that the machine is proportioned accordingly.

Referring first to FIGS. 1 and 2 of the drawings, the machine 10 will be seen to comprise a carriage 14 which is equipped with hauling means 16. A support structure 18 is mounted on the carriage to elevate a windmill assembly 20, part of which is rotated to apply the required cleaning and coating materials to inner surface 22 of the pipe. Machine 10, of course, is intended to travel through the pipe to clean the surface 22 during a first run, and to paint or apply other preservatives to that surface during a subsequent run made in the same direction as the first run.

For such a dual-purpose function, the carriage generally indicated at 14 is provided with a rectangular frame 30 which has a wheel 31 mounted below each corner thereof. The four wheels ride on the surface 22 of the pipe as shown best in FIG. 2 with the curvature of the pipe tending to keep in the machine straight and level as it travels back and forth.

The hauling means generally indicated at 16 preferably comprises a power-driven winding mechanism including two drums 35 although a single drum may be used on machines smaller than the one illustrated in the drawings. Each drum 35 is mounted in a cage-like framework 36 which is secured to the carriage frame 30 near the front end thereof. The transversely aligned drums are each wound with an anchor cable 38, see particularly FIG. 1. An air motor 39 is provided to drive each drum and hoses 40, see FIG. 1 only, are used to connect the two motors to an air compressor or suitable source of power, not shown. Desirably, one of the frameworks 36 is fitted with a control panel 41 such as is shown in FIG. 1. This panel carries the usual control valves 42 and the like for stopping and starting the motors 39, as well as for controlling their speed of rotation. When the unwound ends 44 (FIG. 1) of the cables 38 are secured to suitable anchor means 45 such as a post 46 erected to extend across an end of the pipe remote from the pipe end where the machine is first entered, then the winding means 16 can be operated so that the machine will draw itself through the pipe from the entering end to the remote end of the pipe.

The support structure indicated at 18 is shown to comprise a mast 50 which is mounted on the center of the rear end of the carriage frame 30, the mast being additionally supported by means of braces 51. As best shown in FIG. 3, the telescopic mast is provided with means 52 adjusting its length and therefor has lower and upper sections 53 and 54. A plug 55 is secured within the lower end of section 53 and a threaded shaft 56 fitted with a hand wheel 57 rotatably extends through an opening 58 formed in this plug. This shaft engages a nut 59 secured within the corresponding end of the upper section 54. Thus, by manual rotation of the hand wheel 57, the mast can be extended or retracted and thereby adjusted as to height so as to raise and lower the windmill assembly 20.

The windmill assembly generally indicated at 20 is mounted on top of the mast 50 and, in FIGS. 4 and 5, this assembly will be seen to include a tubular shaft 64 which extends in the same direction as the longitudinal axis of the carriage 14 and is horizontally disposed or parallel to that axis. Shaft 64 is journalled within mounting means 66 which comprises a sleeve 67 having a depending flanged connector 68 (FIG. 4) which is bolted as at 69 to the flanged upper end of the mast section 54. Sleeve 67 is fitted at opposite ends with bearings 72 and 73 with the shaft 64 being rotatably mounted in these bearings so that rear end 75 of the shaft projects well beyond the corresponding end of the sleeve. Secured within the shaft 64 is a liner 76 of a suitable very hard wearing material. Such a material is necessary in order to withstand the abrasive effect of the airborne sand which is used to sandblast the inner surface 22 of the pipe.

The tubular shaft 54 is fitted with radial arms 80 having inner ends 81 which are secured to the shaft end 75 by means of hub 84. These tubular arms 80 are supported by the connecting means or hub in alignment with one another and the length of the arms is such that their outer ends 86 are spaced a suitable distance from the inner surface 22 of the pipe. A nozzle 87 is secured to each outer end 86 of the tubular arms. Each arm 86 is fitted with a wear liner 88 which extends from inner end 81 to the nozzle 87.

The hub 84 is shaped to provide a socket 90 opposite the shaft end 75 and this socket is internally threaded to receive a plug 92. A nut 93 is integrally formed on the outer face of this plug and the plugs inner face 94 is concave so that material discharging from the rear end 75 of the tubular shaft is deflected radially outwards into the tubular arms 80. Thus, air-driven sand is adapted to travel through the shaft 76 and the arms 80 to be directed against the pipe surface 22 by the nozzles 87.

The pipe-cleaning sand is delivered to the tubular shaft 64 through a supply hose 100. This flexible hose has a hard-wearing and flexible liner 101 and one end of the hose is connected to the sleeve 67 by means generally indicated at 104. FIG. 5 shows the coupling means 104 as comprising simply a sleeve coupling 105 having a wear sleeve 106 and opposite end flanges 107 and 108. Bolts 109 secure the flange 107 to a flange 110 formed on the rear end of the sleeve 67. Other bolts 111 serve to fasten the front flange 108 of the sleeve coupling to still another flange 112 on the flexible hose.

The foregoing arrangement effectively connects the rotatable tubular shaft 64 to the non-rotatable supply hose 100, the shaft being driven by means generally indicated at 116 and best shown in detail FIG. 4. Drive means 116 is mounted on a rectangular platform 117 carried by the sleeve 67. On a bracket 118 secured to this platform is mounted an air motor 120 having an inlet 121 fitted with a supply hose 122. An outlet 123 on the opposite side of the motor 120 vents the driving air to atmosphere. The air motor is connected by a hose coupling 125 to a reduction gear 126 also mounted on the platform 117. Drive shaft 127 of the reduction gear is chained and sprocket connected as at 128 to the tubular shaft 64 whereby that shaft and its attached arms 80 can be rotated at a suitably slow speed.

The above described machine 10 is operable to sandblast the inner surface 22 of the pipe which may be an inclined penstock such as is formed at hydroelectric power dam. In describing the operation of the machine; it will be assumed its starting position is at the low end of the pipe and that the anchor cables 38, air hoses 40, and supply hose 100 extend through the pipe to an auxiliary equipment site located near an access opening provided at or near the high end of the pipe. At this site, the cables 38 are anchored to the post 46 or are otherwise secured and the hoses 40 and 100 are connected to the equipment which supplies power to the air motors 39 and wind-driven sand to the assembly 20.

The workmen who operate the machine station themselves alongside the framework 36 and start the air motor 120 to rotate the shaft 64 and arms 80 at a suitable speed. Those workmen then signal other workmen at the equipment site to start the flow of sand and to wind in the supply hose 100 and hoses 40 so that no slack will accumulate to obstruct the passage of the machine through the pipe. The machine operators watch the sand discharging from the nozzles 87 as well as the condition of the pipe interior which is scoured by that abrasive material. At the appropriate moment, the hauling mechanism 16 is started to wind in the cables 38 and move the machine up the pipe incline at a suitably slow speed. The crew walk alongside the machine or, when convenient, actually ride the machine while controlling its progress so as to ensure that the pipe interior is thoroughly cleaned by the sand being forcefully blasted from the rotating arms 80. Care is taken to keep the axis of rotation of the tubular shaft 64 reasonably close to the center of the pipe. As the inside diameter of the pipe changes one of the crew operates the hand wheel 57 to extend and/or retract the mast as required to correctly position the windmill assembly. A single pass of the machine through the pipe usually will be sufficient to remove the rust and other matter which made the cleaning necessary and once the used sand is cleaned from the pipe the machine can be readied for the next operation.

The usual practice is to apply a surface-preserving paint or the like and, for this purpose, the machine 10 is converted for the painting operation by removing the deflector plug 92 from the hub 84 and disconnecting the coupling means 104 to release the hose 100 from the windmill assembly.

Machine 10, see FIG. 6, is provided with an inner tube 140 which is mounted within the tubular shaft 64.

This tube 140 has a rear end 141 which is supported within the hub 84 by means of a plug 143. This threaded support plug has an external nut 144 and a through bore 145, the threaded end 141 of the tube projecting through this bore and being secured by a lock nut 146.

The tube end 141 is connected by means of a T-fitting 150 to a pair of radial arms 152. These tubular arms are aligned with one another and are of a smaller diameter than their counterparts 80 which remain on the windmill assembly 20 during the painting operation. Each arm 152 is fitted at its extreme outer end with a paint-spraying nozzle 153.

The bolts 111 which formerly were used to secure the supply hose 100 to the sleeve 105 are now used to attach to that sleeve another supply hose 160 using another coupling means 162, see FIG. 6. Means 162 is shown to comprise a fitting 163 having a rotatably-mounted part 164 which supports front end 165 of the inner tube. The fitting 163 has a through bore 166 which places the tube 140 in communication with the supply hose 160 non-rotatably attached to the sleeve 105 by the coupling means.

The machine 10 converted from the sand-blasting made to the paint-spraying mode operates substantially as previously described to coat and preserve the interior surface 22 during a second run through the pipe made in the same direction. In other words, the machine is at the high or intake end of the pipe when the sandblasting operation has been completed. The winding means 16 is operated to pay out the cables 38 slowly whereupon the machine rolls by gravity down the inclined penstock. As this movement takes place, the hoses 40 and 100 are provided with slack so that they are drawn through the pipe by the downwardly-rolling machine. The machine reaches the low or discharge end of the penstock and the painting operation can then be started with the machine hauling itself up the incline under control of the painting crew.

From the foregoing it will be apparent the present dual-purpose machine will operate effectively with only a limited amount of auxiliary equipment and while being attended by only a small crew.

What I claim is:

1. A machine for providing first and second treatments to the interior surface of a length of pipe and comprising:

a carriage movable longitudinally through said pipe, a support structure mounted on the carriage, a tubular shaft having opposite ends, mounting means securing the tubular shaft to the support structure for rotation about the longitudinal axis of said shaft and with said axis substantially aligned with the corresponding axis of the pipe, a first plurality of material-conveying tubular arms radially disposed with respect to the tubular shaft and having outer ends near the interior surface and having inner ends, securing means attaching the inner ends of the tubular arms to one end of the tubular shaft, a supply hose connectable at one end thereof to a source of pressure-driven fluid material, a removable deflector member mounted in the securing means opposite the tubular shaft and adapted to deflect the fluid material flowing through the tubular shaft into the first tubular arms, an inner tube extending longitudinally of the tubular shaft and having opposite ends, a support member insertable into the securing means as a replacement for the deflector member and having a central opening through which a portion of the inner tube projects, a second plurality of material-conveying tubular arms radially disposed with respect to the inner tube and having outer ends near the interior surface and inner ends, a fitting securing the inner ends of the second plurality of material-conveying tubular arms to a projecting end of the inner tube, coupling means non-rotatably securing an opposite end of the supply hose to the mounting means in communication with one of the tubular shaft and the inner tube, and drive means on the support structure for rotating the tubular shaft and the tubular arms whereby the fluid material discharging from the outer ends is applied to the interior surface as the carriage moves through the pipe.

2. A machine as claimed in claim 1, and including hauling means for moving the carriage through the pipe.

3. A machine as claimed in claim 2, in which said hauling means comprises a power-driven winding mechanism mounted on the carriage, an anchor cable carried by the winding mechanism and having an unwound end, and anchor means adapted to secure the unwound end against movement longitudinally of the pipe.

4. A machine as claimed in claim 1, in which said support structure comprises a telescopic mast extending upwardly of the carriage, manually-operable means for extending and retracting the telescopic mast.

* * * * *